United States Patent [19]

Stegall

[11] 4,386,800

[45] Jun. 7, 1983

[54] TOOL FOR PULLING CABLE

[76] Inventor: Joe Stegall, 312 Missouri St., Steele, Mo. 63877

[21] Appl. No.: 292,986

[22] Filed: Aug. 14, 1981

[51] Int. Cl.[3] ..... B25B 7/16

[52] U.S. Cl. ..... 294/100

[58] Field of Search ..... 294/100, 118, 19 R; 81/43

[56] References Cited

U.S. PATENT DOCUMENTS

| | | | |
|---|---|---|---|
| 714,989 | 12/1902 | Worthington . | |
| 719,707 | 2/1903 | Williams . | |
| 1,168,115 | 1/1916 | Rueckert . | |
| 1,208,846 | 12/1916 | Sheldon et al. | 294/100 |
| 1,578,800 | 1/1926 | Brandenberger . | |
| 1,816,446 | 7/1931 | Stapf | 294/100 |
| 2,212,013 | 8/1940 | Devareaux . | |
| 2,320,967 | 6/1943 | Dunkelberger | 294/100 |

*Primary Examiner*—James B. Marbert

*Attorney, Agent, or Firm*—Dowell & Dowell

[57] ABSTRACT

A tool for pulling a cable through a hole in a wall where the wall thickness is much greater than the diameter of the hole and where the wall may be filled with insulating materials, the tool having a long slender stem with a tapered shorter sleeve surrounding it, the sleeve having a bore which is a sliding fit on the stem and having a larger bore sized to snuggly receive the cable, and the tool having cable grasping fingers fixed to the end of the rod with hooked ends which are driven into the cable when the sleeve is pulled over the fingers and the end of the cable, the larger bore of the sleeve being longer than the fingers so as to completely cover them and cover a significant length of cable.

1 Claim, 4 Drawing Figures

TOOL FOR PULLING CABLE

BACKGROUND AND PRIOR ART

When adding wiring to an already existing building, it is often very difficult to pass the wiring through double thickness walls, particularly in cases where the walls are filled with some sort of fibrous insulation, and where the holes in the wall must be kept to minimal diameters just sufficient to pass the wiring. It is particularly difficult to pass small diameter cables, such as RG 59 coaxial cable, which has an outer diameter of approximately ¼". In an insulated wall the end of the cable tends to pick up the fibrous insulation and form a ball thereof which usually prevents passage of the cable all the way through the wall.

The present invention seeks to provide improvements over known grappling implements by providing a cable puller particularly well adapted for the purpose set forth above.

The prior art shows many examples of grappling devices employing two or more spring wire fingers which are permitted to separate when a sleeve is retracted on a stem so as to expose a greater length of finger, but which fingers are clamped together at their ends when the sleeve is moved along the stem so as to cover part of the length of the fingers and force their ends together.

Examples of such implements are included in Worthington U.S. Pat. No. 714,989 which shows a grappling device for recovering a well drilling tool from a well bore.

Patents such as Brandenberger U.S. Pat Nos. 1,578,800, Devareaux 2,212,013 and Rueckert 1,168,115 all show tools having multiple spring fingers with inwardly hooked ends.

U.S. Pat. Nos. 719,707 to Williams shows a tool in which the outer surface of the sleeve is tapered, which might make it easier to pull it through a double wall filled with fibrous insulation if it weren't for the blunt end 6 of the instrument.

However, none of these tools in its present form would be suitable for the purpose stated for the present invention, because none of them provides adequate enclosure of the entire end of the cable if the tool were used to pull a cable. One of the features of the present invention is that when the cable is locked to the present pulling tool, the sleeve covers a substantial portion of the length of the cable, leaving none of it, and none of the spring fingers, exposed to snag on the fibrous wall insulation, or on edges of a hole or other objects in the wall through which the cable is being pulled.

THE INVENTION

The present invention comprises an improved pulling tool for pulling a cable through a hole in a wall, where the thickness of the wall is much greater than the diameter of the hole, and where the hole is very little larger in diameter than the cable. The present tool comprises a long slender stem greater in length than the thickness of the wall and having a sleeve surrounding the stem of such outer diameter that it will pass through the hole. The sleeve has an enlarged cylindrical portion with a bore sized to snuggly receive the end of the cable, and the sleeve has a tapered portion leading to a smaller diameter end portion having a smaller bore aligned with the cable receiving bore and snugly receiving the stem, the outer diameter of the sleeve tapering smoothly down in the vicinity of the smaller end portion almost to the diameter of the stem. The tool further includes a cable grasping member comprising plural spring fingers which are wound around the stem at their inner ends and soldered thereto, forming an abutment, and the fingers extending away from the stem within the cable receiving bore of the sleeve. The stem has another stop beyond the smaller diameter bore of the sleeve, and the sleeve is slidable longitudinally of the stem to an unlocked position in which its smaller diameter end approaches the stop on the stem and leaves exposed most of the length of the fingers, thereby permitting them to separate from each other so that their hooked ends are further apart than the diameter of the cable, and the sleeve being movable to a cable locking position in which the sleeve contacts the abutment formed by the ends of the fingers at its smaller diameter bore and in which the cylindrical portion of the sleeve completely encloses the fingers and contacts their hooked ends toward each other in a manner to drive them radially into a cable whose end is then contained entirely within the enlarged cylindrical portion of the sleeve in said locked position, the hooked ends of the fingers lying well within the larger diameter bore of the sleeve.

OBJECTS AND ADVANTAGES OF THE INVENTION

It is a principal object of this invention to provide a cable pulling tool which completely encloses the cable grasping fingers and the end of the cable during the pulling operation so that no portion of the end of the cable or the fingers can snag in fibrous insulation within the wall.

It is another important object of the invention to provide a cable pulling tool having a long thin stem which can be passed completely through the wall before the sleeve portion thereof enters the wall so that the tool can be worked from both ends to pass it through the wall and pull the tapered sleeve with it, the stem and sleeve having no enlargements thereon which would tend to hang up on the wall or any insulation within it.

Still a further object of the invention is to provide an improved construction wherein the inner portions of the fingers are wound around the stem near its end and soldered thereto in order to anchor the fingers to the stem, while at the same time providing an abutment which prevents withdrawal of the stem from the sleeve when the stem is being pulled through the wall to tow the sleeve and cable with it.

Still another object of the invention is to provide a small streamlined tool whose outer diameter is only slightly greater than the outer diameter of the cable being pulled through the wall.

It is still another object of the invention to provide a pulling tool wherein the sleeve is at least twice as long as the spring fingers and pulls over the fingers and the end of the cable so that a least half of the length of the sleeve covers the cable extending back from the hooked ends of the fingers, thereby maintaining the end of the cable accurately aligned axially with the stem. Such alignment is important since it prevents the cable from tilting with respect to the axis of the tool, which has a tendency to break the cable free from the grip of the fingers thereon.

Other objects and advantages of the invention will become apparent during the following discussion of the drawings, wherein:

THE DRAWINGS

PREFERRED EMBODIMENT

Figure 1:
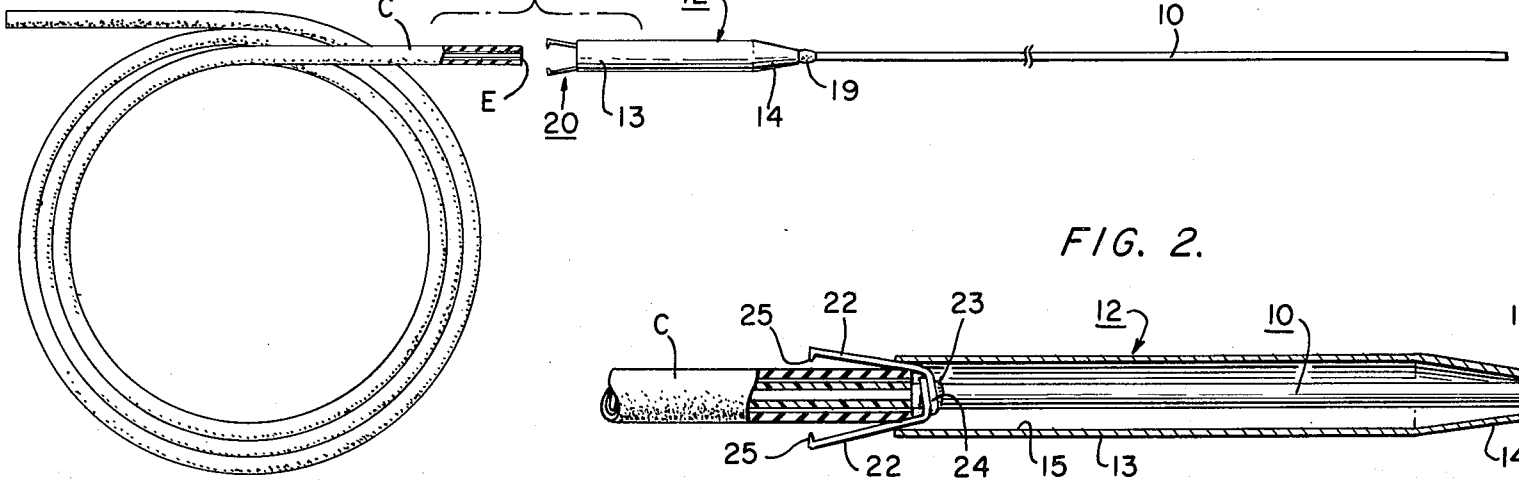
FIG. 1 is an elevation view of a tool according to the invention shown adjacent to a length of cable.

As shown in the drawings, the cable pulling tool of the invention is illustrated as a preferred embodiment of a type particularly useful for pulling RG 59 coaxial cable through a wall where the diameter of the cable is approximately $\frac{1}{4}''$. The tool comprises an elongated stem 10 made for example from $\frac{1}{8}''$ diameter weld rod, the stem being surrounded by a sleeve 12 having a cylindrical portion 13 and a tapered portion 14.

The cylindrical portion 13 has an inner bore 15 whose inner diameter is a little larger than the diameter of the cable C, whereas the bore 16 at the end of the tapered portion 14 is of reduced diameter, only slightly larger than the outer diameter of the stem 10 which is a snug sliding fit therein.

Figure 3:
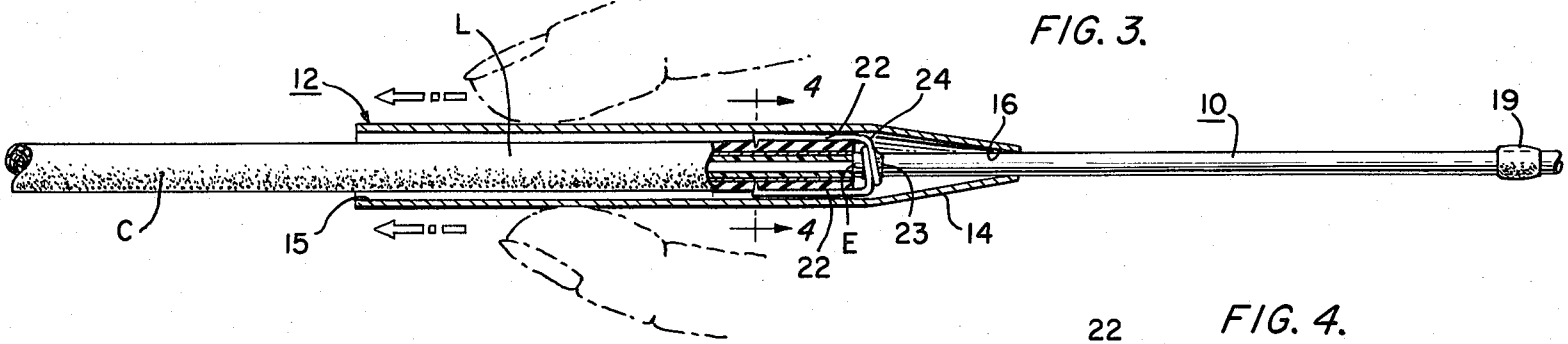
FIG. 3 is a view similar to FIG. 2 but showing the tool locked to the cable.
Figure 4:
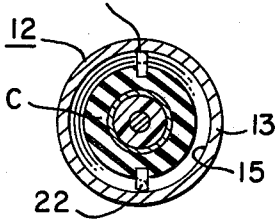
FIG. 4 is an enlarged cross-section view taken along line 4—4 of FIG. 3.

At the end of the stem nearest the sleeve, there is located a cable grasping member 20 comprising plural spring fingers 22 which are wound at their inner ends 23 around the stem 10 and soldered thereto, the spring fingers having hooked outer ends 25 which extend essentially radially toward each other and serve to grasp the cable C by being driven into it in radial directions when the sleeve 12 is pulled over the spring fingers in a manner shown in FIG. 3. The wound inner ends 23 of the spring fingers 22 form an abutment 24 which is too large to pass the smaller bore 16 of the sleeve and thereby prevents withdrawal of the sleeve off of the stem when the stem is being pulled through a wall. On the other hand, a small diameter stop member 19 is provided on the stem spaced above the sleeve and away from the fingers. Since the smaller diameter bore 16 cannot pass over the stop member 19, the sleeve is captivated on the stem near its operative position.

The length of the larger diameter bore 15 of the sleeve is at least twice the length of the fingers 22 so that when the sleeve is pulled over the fingers until the smaller bore 16 strikes the abutment 24, the hooked ends 25 of the fingers will lie well inside of the cylindrical portion 13 of the sleeve, whereby a considerable length L of the cable C including its end E will lie within the sleeve and will be aligned with its axis so that flexing of the cable cannot occur in the vicinity of the fingers, which flexing might tend to loosen their grip on the cable and permit it to be released. The fact that the end of the cable C is well inside the cylindrical portion of the sleeve, and that the hooked ends 25 of the spring fingers are well inside of the sleeve, is a feature of difference with respect to the prior art showings discussed hereinabove, wherein a cable gripped by the hooked ends of the fingers would still lie outside of the sleeve so that if the cable deflected out of axial alignment with respect to the sleeve and stem, its end would be exposed to snag upon the insulation and perhaps other physical members within the wall and prevent its smooth passage through the wall. The feature of having the end E of the cable and the hooked ends of the fingers completely within the cylindrical portion of the sleeve provides a very secure and streamlined assembly to pass through the wall.

Figure 2:
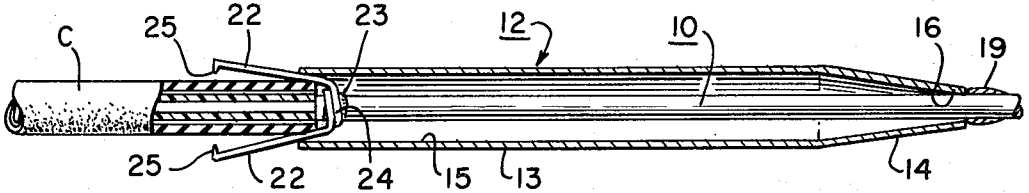
FIG. 2 is an enlarged view partly in section showing the tool in the process of being attached to the cable.

In operation, the sleeve is first moved to the unlocked position as shown in FIG. 2 so as to expose the length of the spring fingers, and the end E of the cable C is placed substantially against the end of the stem near the abutment 24 and is aligned with the axis of the stem. The sleeve is then pulled downwardly to the position shown in FIG. 3 which is the locked position of the sleeve, wherein the sleeve provides a cam action on the spring fingers driving their hooked ends 25 radially into the cable. The sleeve slides still further down to cover the end E of the cable and the hooked ends 25 of the fingers, and a substantial additional length L of the cable beyond the fingers, so that the sleeve 12 maintains correct axially alignment of the cable at all times. The stem is then passed through the wall, and is pulled through so as to tow the sleeve through the wall and through any insulation therein while presenting the gradually tapered end portion 14 of the sleeve to spread the insulating material and make room for passage of the cable behind the sleeve. When the tool and a length of cable have been pulled through the wall, the sleeve is then slid along the stem 10 until its tapered portion 14 touches the stop member 19, at which time the spring fingers separate as shown in FIGS. 1 and 2 to release the cable so that the tool can be removed from its end.

The present invention is not to be limited to the exact form shown in the drawings, for obviously changes can be made within the scope of the following claims.

I claim:

1. A pulling tool for pulling cable through a hole in a wall where the thickness of the wall is much greater than the diameter of the hole, comprising:

a long slender stem sized to pass through the hole and of length greater than the thickness of the wall;

a sleeve surrounding the stem and having an outer diameter sized to pass through the hole, the sleeve having a cylindrical portion with a bore sized to receive the end of the cable, and the sleeve having a tapered portion with a smaller bore communicating with the first mentioned bore and sized to slide snuggly on the stem, the outer surface of the sleeve tapering down gradually from the outer diameter of the cylindrical portion substantially to the diameter of the stem;

a cable grasping member secured to the end of the stem inside said sleeve and comprising spring-wire wound around said end of the stem and soldered to it, the wire extending from the stem inside said cylindrical portion of the sleeve and forming plural fingers having hooked outer ends bent radially inwardly toward each other, the sleeve being moveable along the stem between an unlocked position exposing the hooked ends of the fingers separated from each other by more than the thickness of the cable and a cable locking position in which the fingers and the end of the cable lie entirely inside the cylindrical portion of the sleeve with the hooked ends driven radially into the cable;

the stem supporting a stop member located and operative to limit movement of said sleeve at said unlocked position to keep the soldered portion of the wire just inside the cylindrical portion of the sleeve, said soldered portion of the wire serving as a stop in said locking position by abutting the sleeve near its smaller bore; and the length of the cylindrical portion of the sleeve being at least twice as long as the length of the wire fingers so that in said locking position at least half of the length of the sleeve covers the cable beyond said hooked outer ends of the fingers.

* * * * *